US006755185B2

(12) United States Patent
Esteghlal et al.

(10) Patent No.: US 6,755,185 B2
(45) Date of Patent: Jun. 29, 2004

(54) METHOD AND ELECTRONIC CONTROL UNIT FOR CONTROLLING THE REGENERATION OF A FUEL VAPOR ACCUMULATOR IN INTERNAL COMBUSTION ENGINES

(75) Inventors: Gholamabas Esteghlal, Ludwigsburg (DE); Dieter Lederer, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 16 days.

(21) Appl. No.: 10/129,470

(22) PCT Filed: Aug. 31, 2001

(86) PCT No.: PCT/DE01/03292

§ 371 (c)(1),
(2), (4) Date: Sep. 16, 2002

(87) PCT Pub. No.: WO02/20960

PCT Pub. Date: Mar. 14, 2002

(65) Prior Publication Data

US 2003/0051716 A1 Mar. 20, 2003

(30) Foreign Application Priority Data

Sep. 4, 2000 (DE) ..... 100 43 862

(51) Int. Cl.[7] ..... F02M 33/02
(52) U.S. Cl. ..... 123/520; 477/109
(58) Field of Search ..... 123/520, 519, 123/518, 516, 198 D, 486; 477/107, 109, 110, 111

(56) References Cited

U.S. PATENT DOCUMENTS

| | | | | |
|---|---|---|---|---|
| 4,683,861 A | | 8/1987 | Breitkreuz et al. | |
| 5,125,385 A | | 6/1992 | Frinzel | |
| 5,216,997 A | * | 6/1993 | Osanai et al. | 123/698 |
| 5,323,751 A | * | 6/1994 | Osanai et al. | 123/520 |
| 5,496,228 A | | 3/1996 | Takata et al. | |
| 5,778,859 A | * | 7/1998 | Takagi | 123/520 |
| 5,988,151 A | * | 11/1999 | Schneider | 123/698 |
| 6,012,435 A | | 1/2000 | Takahashi et al. | |
| 6,041,761 A | * | 3/2000 | Uto et al. | 123/516 |
| 6,089,210 A | * | 7/2000 | Kadowaki | 123/520 |

FOREIGN PATENT DOCUMENTS

| | | |
|---|---|---|
| EP | 0 785 355 | 7/1997 |
| JP | 8-14119 | 1/1996 |
| WO | WO 00/09881 | 2/2000 |

OTHER PUBLICATIONS

Patent Abstracts of Japan, vol. 1996, No. 05, May 31, 1996.

* cited by examiner

*Primary Examiner*—Mahmoud Gimie
(74) *Attorney, Agent, or Firm*—Kenyon & Kenyon

(57) ABSTRACT

Method for controlling a tank venting valve between an internal combustion engine and a fuel vapor storage unit, with the stored fuel vapor being supplied from the fuel vapor storage unit to the internal combustion engine when the tank venting valve is open. A distinction is made between active and inactive tank venting phases, and the purge rate is preset during active tank venting by a purge rate setting means as a function of operating parameters of the engine and/or the tank venting system. If the duration of the inactive tank venting phase exceeds a minimum duration, the purge rate in the subsequent active tank venting phase is temporarily limited to a value below the rate preset by the purge rate setting means.

20 Claims, 3 Drawing Sheets

METHOD AND ELECTRONIC CONTROL UNIT FOR CONTROLLING THE REGENERATION OF A FUEL VAPOR ACCUMULATOR IN INTERNAL COMBUSTION ENGINES

FIELD OF THE INVENTION

The present invention relates to a method for controlling a tank venting valve between an internal combustion engine and a fuel vapor storage unit.

BACKGROUND INFORMATION

Methods for controlling the regeneration of an intermediate fuel vapor storage unit in internal combustion engines are described in U.S. Pat. No. 4,683,861.

The intermediate fuel vapor storage unit may be implemented in the form of an active charcoal filter. It absorbs fuel vapor evaporating in the fuel tank. The active charcoal filter is regenerated by purging it with air. The purging air flows through the active charcoal filter, where it absorbs fuel, and is supplied to the internal combustion engine in the form of fuel-laden regeneration gas. The regeneration of the active charcoal filter by purging it with air is accomplished, for example, by opening a tank venting valve between the active charcoal filter and the intake manifold of the internal combustion engine. The intake manifold vacuum acts in this case as the driving force for purging the filter via a fresh air opening. The flow of the fuel-laden regeneration gas follows the pressure gradient, reaching the internal combustion engine via the tank venting valve.

According to conventional methods, regeneration occurs only in certain engine operating states. In engines with gasoline direct injection, operation with homogeneous distribution of the air/fuel mixture in the combustion chambers is especially suitable, since the regeneration gas also enters the combustion chambers in the form of a homogeneous mixture of air and fuel.

The lean mode of operation with stratified charge distribution favored in gasoline direct injection engines is less suitable, however, because the premixed regeneration gas interferes with the injection jet-controlled charge stratification.

As described in U.S. Pat. No. 6,012,435, in the case of long-lasting stratified-charge operation, regeneration of the active charcoal filter does not, under some circumstance, occur for a longer period of time if the engine is operated in stratified mode for a longer period of time. If this period exceeds a threshold, the engine switches to homogeneous mode, according to U.S. Pat. No. 6,012,435, to allow regeneration of the active charcoal filter.

Depending on the amount of fuel vapor that has been absorbed by the active charcoal filter prior to regeneration, the filter may be laden with more or less fuel. Consequently, the regeneration gas may contain a greater or smaller amount of fuel following regeneration after a longer inactive tank venting phase.

To equalize the fuel volume that is supplied to the internal combustion engine along with the regeneration gas, the amount of fuel flowing via the injectors is usually reduced.

If the regeneration gas is very rich in fuel at the time regeneration begins, the entire fuel volume supplied to the engine is large enough to produce unwanted HC emissions.

It is an object of the present invention to provide an emission-neutral method for supplying regeneration gas in internal combustion engines with tank venting, thereby reducing unwanted HC emissions, without impairing driving comfort or adversely affecting engine torque. It is another object of the present invention to maximize the purging volume under the given ancillary conditions.

SUMMARY

The present invention relates to a method for controlling a tank venting valve between an internal combustion engine and a fuel vapor storage unit, with the stored fuel vapor being supplied from the fuel vapor storage unit to the internal combustion engine when the tank venting valve is open. According to the method, a distinction is made between active and inactive tank venting phases, and, when tank venting is active, the opening state of the tank venting valve is preset by a fuel setting arrangement as a function of first operating parameters of the engine and/or the tank venting system and limited by a purge rate limiting arrangement as a function of second operating parameters, or preset by a purge rate setting arrangement as a function of second operating parameters and/or limited by a flow rate factor as a function of third operating parameters.

According to one example embodiment, the first operating parameters of the engine and/or the tank venting system include values for the speed and at least one of the following operating parameters:

Torque

Necessary fuel mass

Intake air temperature

Mixture composition and

Charge distribution in the combustion chamber

According to another example embodiment, the second operating parameters include the integral value of the mass flow via the tank venting valve.

According to a further example embodiment, the third operating parameters depend at least on the speed and the quotient of the intake manifold pressure and the ambient pressure.

According to a further example embodiment, a distinction is made between the active and inactive tank venting phases, and, if the duration of the inactive tank venting phase exceeds a minimum duration, the opening state of the tank venting valve is temporarily limited in the subsequent active tank venting phase to a value below the value preset by the purge rate limiting arrangement or the purge rate setting arrangement.

The present invention also relates to a method for controlling a tank venting valve between an internal combustion engine and a fuel vapor storage unit, with the stored fuel vapor being supplied from the fuel vapor storage unit to the internal combustion engine when the tank venting valve is open, with the internal combustion engine being coupled with a torque converter whose transmission ratio is changeable during internal combustion engine operation, and in which a torque supplied by the internal combustion engine is temporarily reduced during a change in the transmission ratio, wherein the tank venting valve is temporarily closed upon a change in the transmission ratio and a reduction in the torque supplied by the internal combustion engine.

According to a further example embodiment, the purge rate is defined as a quotient of the mass flow via the tank venting valve and the entire mass flow into the intake manifold.

According to a further example embodiment, the purge rate limitation is canceled if the period during which the reduction was active exceeds a predetermined threshold.

According to a further example embodiment, the purge rate limitation is canceled if a measure of the regeneration gas volume flowing to the engine exceeds a threshold value.

According to a further example embodiment, the above-mentioned measure is formed as a function of the integral of the mass flow via the tank venting valve or as a function of the integral over the purge rate.

According to a further example embodiment, the method is used in an internal combustion engine with gasoline direct injection, with tank venting being limited even if undesirably high lambda deviations occur during active tank venting.

If the internal combustion engine is operated with a stratified charge, according to a further example embodiment, the relative change in the low-pass-filtered lambda setpoint is analyzed; and tank venting is limited on account of unwanted high lambda deviations during active tank venting only if the relative change in the low-pass-filtered lambda setpoint is smaller than a predetermined threshold value.

The present invention also relates to an electronic control device for performing at least one of the methods and example embodiments.

According to the methods, a distinction is made between active and inactive tank venting phases, and, in the case of active tank venting, the purge rate is preset by a fuel setting arrangement as a function of operating parameters of the engine and/or the tank venting system and limited by a purge rate limiting arrangement or preset by a purge rate setting arrangement. If the duration of the inactive tank venting phase exceeds a minimum duration, the purge rate in the subsequent active tank venting phase is temporarily limited to a value below the rate preset by the purge rate limiting arrangement or the purge rate setting arrangement.

The method according to the present invention may prevent a change in the load state of the active charcoal filter that occurred during a long inactive tank venting phase from resulting in an unwanted increase in the entire fuel flow to the internal combustion engine. As a result, it may be possible to avoid an unwanted increase in HC emissions following long inactive tank venting phases without having to reduce the wanted high regeneration rates following shorter inactive tank venting phases.

Because the limitation is only temporary, it may also be possible to avoid unwanted limiting of the regeneration rates during longer active tank venting phases.

On the whole, this encourages a wanted high regeneration rate without increased HC emissions during the transition from inactive to active tank venting.

Example embodiments of the present invention are explained below on the basis of the drawings.

DETAILED DESCRIPTION

Figure 1:
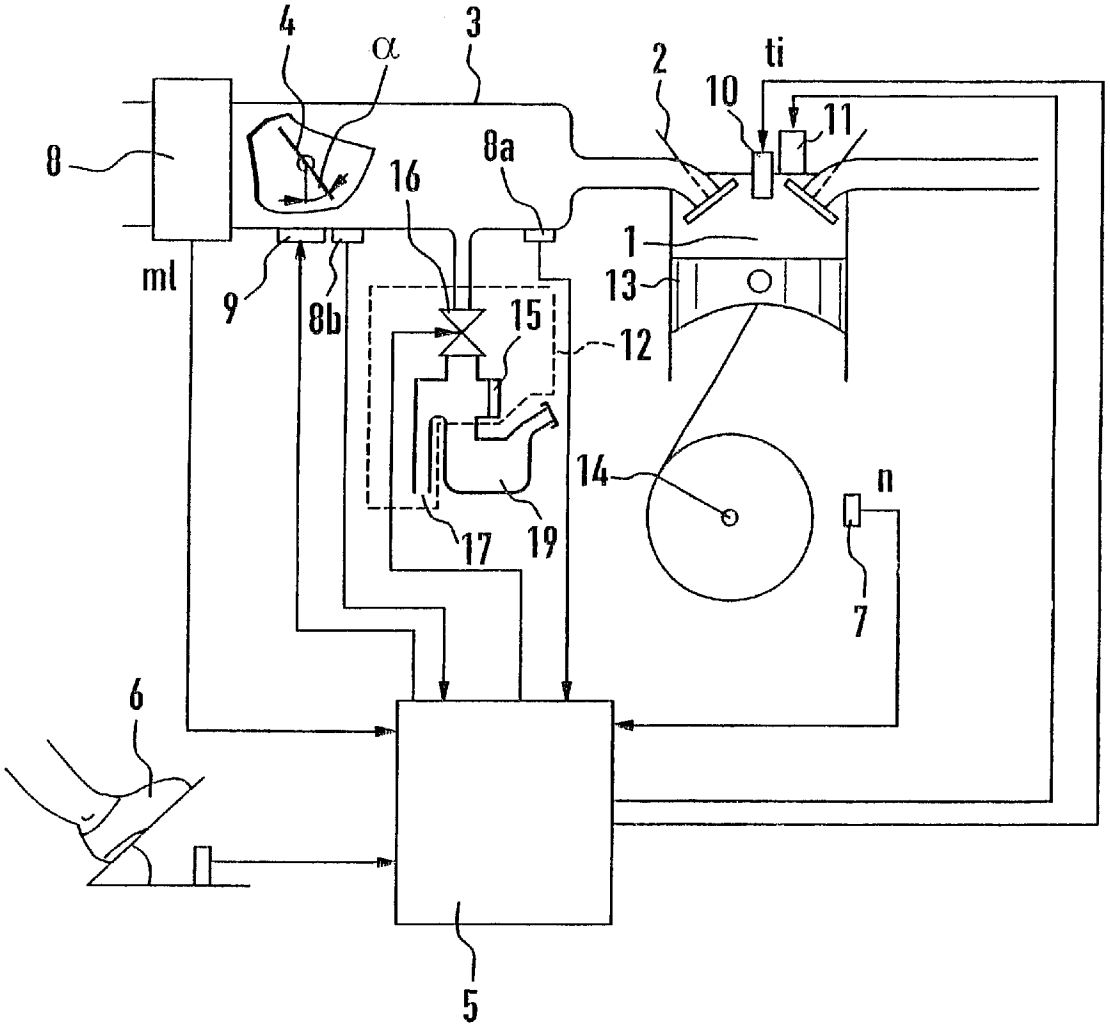
FIG. 1 illustrates the technical background of the present invention.

Reference number 1 in FIG. 1 represents the combustion chamber of a cylinder of an internal combustion engine. The inflow of air into the combustion chamber is controlled by an intake valve 2. The air is drawn in by an intake manifold 3. The intake air volume may be varied by a throttle valve 4, which is controlled by a control unit 5. Signals corresponding to the torque request by the driver, e.g., via the position of a gas pedal 6, a signal indicating engine speed n of an engine speed sensor 7 and a signal indicating volume ml of the intake air by an air flow sensor 8, are supplied to the control unit.

An intake manifold pressure sensor 8*a* and/or a throttle valve position sensor 8*b* for measuring the air flow is provided in addition or as an alternative to air flow sensor 8.

In the discussion below, the term "charge detection" in place of "air flow measuring" is used. The term "charge" paraphrases the air volume relative to the charge of a single cylinder. In a first approximation, this is the measured air volume, divided by the number of cylinders and speed and thus normalized to a stroke.

Based on these and possibly other input signals corresponding to additional parameters of the internal combustion engine, such as intake air and coolant temperature, control unit 5 forms output signals for setting throttle valve angle alpha by an actuator 9 and for controlling a fuel injector 10 that meters the fuel into the engine combustion chamber. The control unit also controls ignition triggering via an ignition device 11.

The control unit also controls a tank venting system 12 as well as other functions for the efficient combustion of the air/fuel mixture in the combustion chamber. The gas force resulting from combustion is converted to a torque by pistons 13 and crank mechanism 14.

Tank venting system 12 includes an active charcoal filter 15, which communicates via corresponding lines or connections with the tank, ambient air and the intake manifold of the internal combustion engine, with a tank venting valve 16 being provided in the line to the intake manifold.

Active charcoal filter 15 stores fuel evaporating in tank 19. As tank venting valve 11 is opened by control unit 6, air is drawn in from environment 17 through the active charcoal filter, which releases the stored fuel into the air. This air/fuel mixture, which is also referred to as tank venting mixture or regeneration gas, influences the composition of the entire mixture supplied to the internal combustion engine, which is further determined by metering fuel via fuel metering device 10, which is adjusted to the indrawn air volume. In extreme cases, the fuel drawn in via the tank venting system may be in a proportion of approximately one third to one half of the entire fuel volume.

Figure 2:
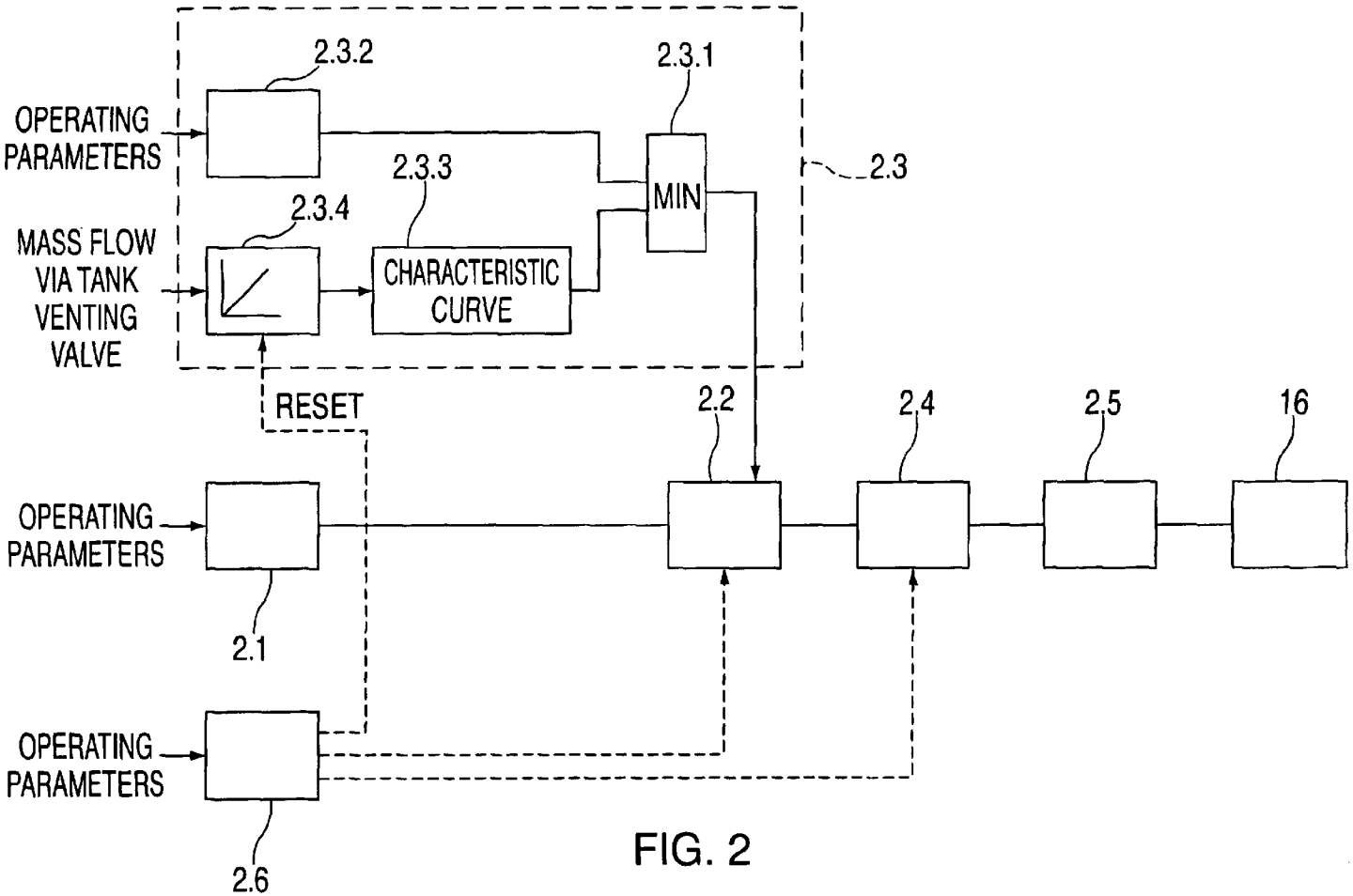
FIG. 2 illustrates an example embodiment of the present invention in the form of function blocks.

FIG. 2 is a function block diagram illustrating an example embodiment of the method according to the present invention for controlling the tank venting valve.

Block 2.1 represents a fuel rate setting arrangement that may be implemented, for example, in the form of a characteristics map storage unit.

The fuel rate is first determined as a function of the engine operating point. The fuel portion is converted to a purge rate in block 2.2 and limited to a maximum value dependant on the operating point by a purge rate limiting arrangement 2.3.

The fuel rate may be defined as the quotient of the fuel supplied via the tank venting valve and the entire fuel supplied to the internal combustion engine, and the purge rate may be defined as the quotient of the mass flow via the tank venting valve and the entire mass flow into the intake manifold.

The operating point is defined by engine operating parameters such as speed, torque, necessary fuel mass, intake air temperature, mixture composition and charge distribution in the combustion chamber. These operating parameters are partially preset by the control unit and/or detected by sensors. For example, the control unit determines whether the engine is to operate in homogeneous charge distribution mode or in stratified charge distribution mode. The torque is formed by control unit-detected operating parameters such as speed and intake air volume, intake air temperature, throttle valve angle, and intake manifold pressure. The mixture composition may be calculated from quantities present in the control unit, such as the fuel flow via the injectors and the cylinder charge, or it may be determined metrologically by an exhaust gas analyzing probe.

The engine may process larger fuel rates and purge rates, and thus larger volumes of regeneration gas, in some operating points than others, and a fuel rate setting arrangement and a purge rate setting arrangement therefore may preset suitable fuel and purge rates as a function of the operating point.

The purge rate is converted in block 2.2. to a control pulse duty factor for tank venting valve 16. The calculation may incorporate, for example, mass flow mdk via the engine throttle valve to first determine a desired mass flow via the tank venting valve, based on the purge rate. This function is represented by block 2.4. For example, if the purge rate is 20% and the mass flow via the throttle valve is 4 kg/hour, this yields a desired mass flow of 1 kg/hour via the tank venting valve. An opening pulse duty factor corresponding to this flow rate for controlling the tank venting valve is obtainable, for example, from a characteristics map that additionally includes the pressure difference between the intake manifold and the tank venting system. This pressure difference, in turn, may be estimated on the basis of intake manifold pressure psaug, which is either measured or modeled in the control unit.

According to the present invention, the control signal determined in this manner is additionally limited temporarily.

A minimum selection (block 2.3.1) between the maximum value of the purge rate selected from a characteristics map (block 2.3.2) and a limit value of the purge rate from a block 2.3.3 is suitable for this purpose.

The limit value may be obtained from a characteristic curve (block 2.3.3) that is addressed by the integral value of the mass flow via the tank venting valve (block 2.3.4), with the integral value being reset to zero by controller 2.6 during inactive tank venting phases that exceed a minimum duration.

The integral value of the mass flow via the tank venting valve may be taken into account, because it is a measure of the purge volume passing through the active charcoal filter. If this value exceeds a minimum, which may correspond, for example, to the volume in the line between the active charcoal filter and the intake manifold, abrupt changes in the HC concentration in the regeneration gas should no longer be expected, and it is no longer necessary to limit the purge rate.

The mass flow via the tank venting valve is determinable, for example, from the real purge rate supplied also to block 2.4 and mass flow mdk via the throttle valve.

According to the present invention, the reduction is triggered when the length of an operating phase without opening of the tank venting valve exceeds a preselected value. The changeover between active and inactive tank venting is controlled by a sequence control system 2.6. The sequence control system detects the mass flow via the tank venting valve, and thus the length of the inactive tank venting phases, and compares it to a preselected threshold value. If the period of inactivity exceeds the duration defined by the preselected threshold value, the integral value of the mass flow via the tank venting valve is reset to zero. As a result, the purge rate limitation remains in effect during the next active tank venting phase until the integral value of the mass flow exceeds the minimum value preset in characteristic curve 2.3.3.

As an alternative, the purge rate itself or its maximum value may be multiplicatively reduced instead of using the minimum selection.

The period during which the reduction was in effect may be used as a criterion for the duration of the reduction. If this period exceeds a preset threshold, the reduction is cancelled.

As an alternative to the determination of the purge rate from the preset fuel rate, the purge rate may be preset directly.

The tank venting limitation goes beyond the interventions mentioned above in the following operating states:

A reduction torque that may result in injection interruptions is activated in the case of gear changes in automatic transmissions. To avoid an increase in HC emissions, the tank venting valve closes upon receipt of the gear change request and opens again after a delay when injection resumes.

Operation data acquisition specific: If undesirably high lambda deviations occur during tank venting, for example due to the use of an unbuffered active charcoal filter, tank venting is immediately limited by regulated manipulation of the limit value. To avoid manipulation of the limit value regulation following an operating point change in stratified mode, it may be necessary to distinguish between an operating point change and lambda deviations, which may also be reliably detected. For this purpose, the relative change in the low-pass-filtered lambda setpoint is analyzed and weighted, so that only low values result in manipulation of the limit value, while high values are interpreted as an operating point change.

Figure 3:
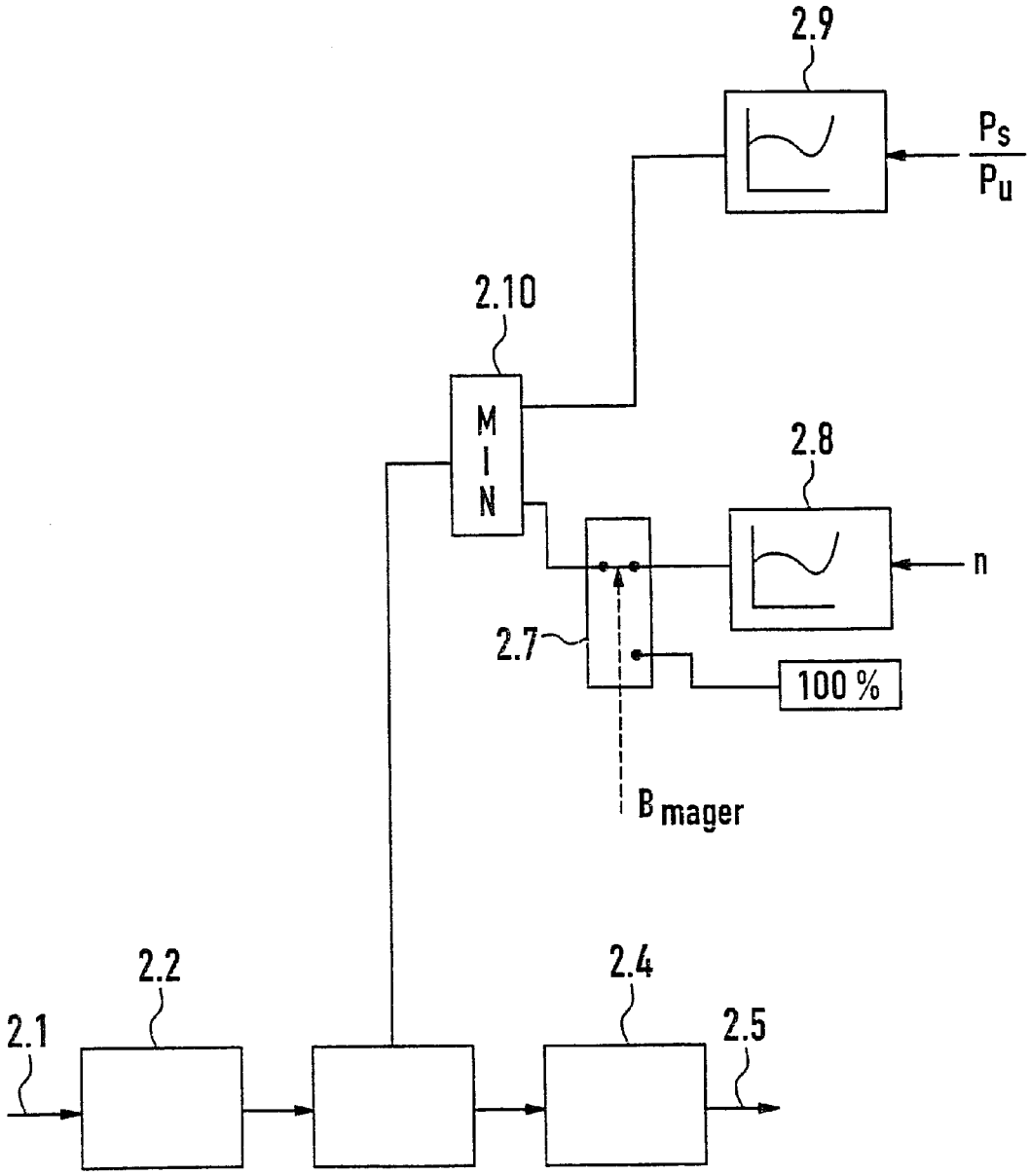
FIG. 3 illustrates a modification of the example embodiment illustrated in FIG. 2.

Operation data acquisition specific: Due to the poor combustion characteristics of the spatially homogeneous regeneration gas in stratified mode, opening of the tank venting valve is limited as a function of speed. In FIG. 3, a switch switches a limiting characteristics map 2.8, instead of a fixed value (100%), to a minimum selection 2.10 in lean mode (control signal: Bmager). A further limiting characteristics map 2.9 is addressed by the quotient of pressures Ps (intake manifold pressure) and pressure in tank venting system Pu (approximately equal to the ambient pressure). Block 2.10 makes a minimum selection between the output quantities of the characteristics maps. A flow rate factor is formed in block 2.11. In the structure illustrated in FIG. 2, block 2.11 is positioned between block 2.2 and block 2.4 so that intervention via the flow rate factor has an additional or supplementary limiting effect.

Operation data acquisition specific: To regenerate the NOx storage catalytic converter, which may be necessary at regular intervals, the engine is operated with a rich mixture that may reach lambda values of up to 0.7. Because the measuring accuracy of the lambda probe is insufficient in this range, the regeneration gas charge may not be adapted during simultaneous tank venting. To avoid switching to controlled tank venting with a very low purge rate, which ordinarily occurs within this lambda range, the tank venting purge rate is reduced by an applicable factor when the NOx storage catalytic converter is regenerated with lambda values below a certain threshold.

Operation data acquisition specific: Switching between the different operating modes (homogeneous, homogeneous-lean and stratified) may occur smoothly. To minimize possible interference potential on the part of the tank venting system, the regeneration gas charge is divided into low, medium and high segments and only certain operating modes and changes may be allowed as a function thereof. Independently thereof, the fuel portion of the tank venting is limited to an applicable value upon switching between different operating modes relative to the combustion process (homogeneous, stratified), i.e., opening of the tank venting valve may be reduced prior to switching. A common configuration is:

High charge: homogeneous mode; no switching;

Medium charge: homogeneous, homogeneous-lean, homogeneous-stratified modes; switching;

Low charge: all operating modes; switching.

The limitations described above may achieve a largely emission-neutral tank venting process that does not impair driving comfort. They also may avoid unwanted HC emissions resulting from a tank venting strategy that is imprecisely tuned to the operating states, as well as unwanted influences on torque; at the same time the purge rate may be maximized under the given ancillary conditions.

What is claimed is:

1. A method for controlling a tank venting valve arranged between an internal combustion engine and a fuel vapor storage unit, comprising the steps of:

supplying stored fuel vapor from the fuel vapor storage unit to the internal combustion engine when the tank venting valve is open;

distinguishing between an active tank venting phase and an inactive tank venting phase;

presetting an opening state of the tank venting valve during the active tank venting phase by a fuel setting arrangement as a function of first operating parameters of at least one of the internal combustion engine and a tank venting system; at least one of:

limiting the opening state of the tank venting valve by a purge rate limiting arrangement as a function of second operating parameters, or presetting the opening state of the tank venting valve by a purge rate setting arrangement as a function of second operating parameters; and limiting the opening state of the tank venting valve by a flow rate factor as a function of third operating parameters; and temporarily limiting when a duration of the inactive tank venting phase exceeds a minimum duration, the opening state of the tank venting valve in a subsequent active tank venting phase to a value below a value preset by one of the purge rate limiting arrangement and the purge rate setting arrangement.

2. The method according to claim 1, wherein the first operating parameters include values for speed and at least one of a torque, a necessary fuel mass, an intake air temperature, a mixture composition and a charge distribution in a combustion chamber.

3. The method according to claim 1, wherein the second operating parameters include an integral value of a mass flow via the tank venting valve.

4. The method according to claim 1, wherein the third operating parameters depend at least on a speed and a quotient of an intake manifold pressure and an ambient pressure.

5. The method according to claim 1, wherein the purge rate includes as a quotient of a mass flow via the tank venting valve and an entire mass flow into an intake manifold.

6. The method according to claim 1, further comprising the step of canceling the purge rate limitation when a period during which a reduction was active exceeds a predetermined threshold.

7. The method according to claim 1, further comprising the step of canceling the purge rate limitation when a measure of a regeneration gas volume flowing to the engine exceeds a threshold value.

8. The method according to claim 7, wherein the measure of the regeneration gas volume depends on one of an integral of a mass flow via the tank venting valve and an integral over to the purge rate.

9. The method according to claim 1, wherein the method is performed in an internal combustion engine with gasoline direct injection, the tank venting limited even when unwanted high lambda deviations occur during active tank venting.

10. A method for controlling a tank venting valve arranged between an internal combustion engine and a fuel vapor storage unit, comprising the steps of:

supplying stored fuel vapor from the fuel vapor storage unit to the internal combustion engine when the tank venting valve is open;

distinguishing between an active tank venting phase and an inactive tank venting phase;

presetting an opening state of the tank venting valve during the active tank venting phase by a fuel setting arrangement as a function of first operating parameters of at least one of the internal combustion engine and a tank venting system;

at least one of:

limiting the opening state of the tank venting valve by a purge rate limiting arrangement as a function of second operating parameters, or presetting the opening state of the tank venting valve by a purge rate setting arrangement as a function of second operating parameters; and limiting the opening state of the tank venting valve by a flow rate factor as a function of third operating parameters;

analyzing, when the internal combustion engine is operated with a stratified charge, a relative change in a low-pass-filtered lambda setpoint; and limiting tank venting as a result of unwanted high lambda deviations during active tank venting only when the relative change in the low-pass-filtered lambda setpoint is less than a predetermined threshold value;

wherein the method is performed in an internal combustion engine with gasoline direct injection, the tank venting limited even when unwanted high lambda deviations occur during active tank venting.

11. An control unit configured to control a tank venting valve arranged between an internal combustion engine and a fuel vapor storage unit the control unit comprising:

an electronic control unit that is operable to perform the following:

supplying stored fuel vapor from the fuel vapor storage unit to the internal combustion engine when the tank venting valve is open;

distinguishing between an active tank venting phase and an inactive tank venting phase;

presetting an opening state of the tank venting valve during the active tank venting phase by a fuel setting arrangement as a function of first operating parameters of at least one of the internal combustion engine and a tank venting system;

at least one of:

limiting the opening state of the tank venting valve by a purge rate limiting arrangement as a function of second operating parameters, or presetting the opening state of the tank venting valve by a purge rate setting arrangement as a function of second operating parameters; and limiting the opening state of the tank venting valve by a flow rate factor as a function of third operating parameters;

analyzing, when the internal combustion engine is operated with a stratified charge, a relative change in a low-pass-filtered lambda setpoint; and limiting tank venting as a result of unwanted high lambda deviations during active tank venting only when the relative change in the low-pass-filtered lambda setpoint is less than a predetermined threshold value;

wherein the electronic control device is arranged in an internal combustion engine with gasoline direct injection, the tank venting limited even when unwanted high lambda deviations occur during active tank venting.

12. An control unit configured to control a tank venting valve arranged between an internal combustion engine and a fuel vapor storage unit, the control unit comprising:

an electronic control unit that is operable to perform the following:

supplying stored fuel vapor from the fuel vapor storage unit to the internal combustion engine when the tank venting valve is open;

distinguishing between an active tank venting phase and an inactive tank venting phase;

presetting an opening state of the tank venting valve during the active tank venting phase by a fuel setting arrangement as a function of first operating parameters of at least one of the internal combustion engine and a tank venting system;

at least one of:

limiting the opening state of the tank venting valve by a purge rate limiting arrangement as a function of second operating parameters, or presetting the opening state of the tank venting valve by a purge rate setting arrangement as a function of second operating parameters; and limiting the opening state of the tank venting valve by a flow rate factor as a function of third operating parameters; and temporarily limiting when a duration of the inactive tank venting phase exceeds a minimum duration, the opening state of the tank venting valve in a subsequent active tank venting phase to a value below a value preset by one of the purge rate limiting arrangement and the purge rate setting arrangement.

13. The electronic control device according to claim 12, wherein the first operating parameters include values for speed and at least one of a torque, a necessary fuel mass, an intake air temperature, a mixture composition and a charge distribution in a combustion chamber.

14. The electronic control device according to claim 12, wherein the second operating parameters include an integral value of a mass flow via the tank venting valve.

15. The electronic control device according to claim 12, wherein the third operating parameters depend at least on a speed and a quotient of an intake manifold pressure and an ambient pressure.

16. The electronic control device according to claim 12, wherein the purge rate includes as a quotient of a mass flow via the tank venting valve and an entire mass flow into an intake manifold.

17. The electronic control device according to claim 12, wherein the method further includes the step of canceling the purge rate limitation when a period during which a reduction was active exceeds a predetermined threshold.

18. The electronic control device according to claim 12, wherein the method further includes the step of canceling the purge rate limitation when a measure of a regeneration gas volume flowing to the engine exceeds a threshold value.

19. The electronic control device according to claim 18, wherein the measure of the regeneration gas volume depends on one of an integral of a mass flow via the tank venting valve and an integral over to the purge rate.

20. The electronic control device according to claim 12, wherein the electronic control device is arranged in an internal combustion engine with gasoline direct injection, the tank venting limited even when unwanted high lambda deviations occur during active tank venting.

* * * * *